United States Patent [19]

Furuya et al.

[11] Patent Number: 4,841,618

[45] Date of Patent: Jun. 27, 1989

[54] METHOD OF MANUFACTURING AN ELECTROCAST SHELL HAVING PERMEABILITY

[75] Inventors: Tamio Furuya, Hidaka; Yuichi Tazaki, Sakado; Toshiyuki Kinugasa, Hidaka; Yoshiki Ishige, Tokorozawa; Yuichi Tsuchimoto, Sakado, all of Japan

[73] Assignee: Honda Giken Kogyo Kabushiki Kaisha, Tokyo, Japan

[21] Appl. No.: 106,238

[22] Filed: Oct. 8, 1987

Related U.S. Application Data

[63] Continuation of Ser. No. 813,252, Dec. 24, 1985, abandoned.

[30] Foreign Application Priority Data

Jan. 11, 1985 [JP] Japan ..... 60-2669

[51] Int. Cl.[4] ..... C25D 1/08

[52] U.S. Cl. ..... 29/423; 204/11

[58] Field of Search ..... 204/11; 29/423

[56] References Cited

U.S. PATENT DOCUMENTS

| | | | |
|---|---|---|---|
| 3,135,044 | 6/1964 | Mote, Jr., et al. | 29/423 |
| 3,167,489 | 1/1965 | Hadjian | 204/11 |
| 3,293,737 | 12/1966 | Falkenau et al. | 29/423 |
| 4,053,371 | 10/1977 | Towsley | 204/11 |

*Primary Examiner*—Lowell A. Larson

*Attorney, Agent, or Firm*—Roberts, Spiecens & Cohen

[57] ABSTRACT

A method of manufacturing an air permeable electrocast shell comprising forming a conductive layer on the surface of a model, placing a layer of elutable particles into close contact with the surface of the conductive layer and effecting an electrocasting treatment to deposit metal between the conductive layer and the particles, except for the points of contact between the conductive layer and the particles, and between adjoining particles. The deposit of the metal is controlled so that the thickness of the electrocast shell is less than that of the particle layer. Thereafter, the particles are eluted from the electrocast shell to form innumberable fine vent holes which open at both surfaces of the electrocast shell.

21 Claims, 5 Drawing Sheets

METHOD OF MANUFACTURING AN ELECTROCAST SHELL HAVING PERMEABILITY

This is a continuation on application Ser. No. 813,252 filed 12/24/85, now abandoned.

FIELD OF THE INVENTION

The present invention relates to a method of manufacturing an electrocast shell which is provided with permeability and which is used, for example, for imprinting or embossing patterns onto the surface of a heated plastic sheet by application of suction force to the sheet.

PRIOR ART

A known method of manufacturing an electrocast shell of this type comprises forming a conductive layer on a surface of a model; applying an electrocasting treatment to the model to deposit metal thereon as an electrocast shell; separating the electrocast shell from the conductive layer; and forming a multitude of vent holes in the shell for applying suction force to the sheet to be imprinted, the holes being formed by a boring operation such as, drilling, laser processing and the like.

Another method for forming the vent holes comprises mounting a multitude of fibers, such as organic fibers, insulation-processed metal fibers etc. on the conductive layer of the model and after effecting the electrocasting treatment on the model in a manner similar to the above to form the electrocast shell and separating the electrocast shell from the conductive layer, the fibers are extracted from the electrocast shell to form the vent holes.

However, these known methods have various disadvantages. Namely, in the case of boring the holes, expensive equipment is required. In laser processing, a focus adjustment has to be carried out according to the thickness of the electrocast shell to control the diameter of the vent holes, which adversely effects the workability of the process. In drilling, there is a limit to the diameter of the drill beyond which smaller diameter holes cannot be obtained. When the vent holes are too large they leave an imprint on the plastic sheet. Even if the pitch of the vent holes can be suitably controlled in the known processes, the number of steps increases to obtain a multitude of vent holes, resulting in extremely poor productivity.

In the case of forming holes by extraction of fibers, the diameter of the holes is limited to the diameter of the fibers. Since the fibers are mounted on the conductive layer, there is a limit in the number thereof. Thus, a sufficient number of vent holes cannot be obtained. The number of steps is great due to the mounting of the fibers and their extraction resulting in extremely poor productivity.

SUMMARY OF THE INVENTION

It is an object of the present invention to provide a method for manufacture of an electrocast shell in which when the electrocast shell is formed, elutable particles are introduced therein, after which the particles are eluted from the electrocast shell, whereby innumerable fine vent holes are formed in the shell in very simple fashion.

According to the present invention in order to achieve the aforementioned object, there is provided a method of manufacturing an electrocast shell with permeability or porosity by the steps comprising forming a conductive layer on the surface of a model; placing a layer of elutable particles into close contact with the surface of the conductive layer; effecting an electrocasting treatment on the model so that portions between the conductive layer and the particles, except the contact points between the conductive layer and the particles, and between adjoining particles are filled by deposited metal to obtain an electrocast shell whose thickness is less than that of the layer of particles; and thereafter eluting the particles from the electrocast shell to form a multitude of intercommunicating fine vent holes having openings at both sides of the electrocast shell.

As described above, when the electrocast shell is formed, elutable particles are introduced therein and thereafter the particles are eluted from the electrocast shell to form vent holes. Thereby, a microporous body is obtained which is open at both sides and therefore, it is possible to manufacture an electrocast shell having permeability, by extremely simple means, with a minimum number of steps efficiently and easily and with excellent productivity.

Furthermore, the pitch of the openings of the vent holes can be suitably controlled according to the diameter of the particles. Moreover, the diameter of the openings of the vent holes can be suitably varied using a procedure such as chemical etching and the like.

In addition, it is possible to obtain a permeable electrocast shell having various shapes according to the shape of the models, and having excellent general-use properties.

Furthermore, the diameter of the openings of the shell at the conductive layer may be made very small to increase the number of openings of the vent holes at the surface of the electrocast shell whereas the diameter of the particles located in the next layer or layers may be increased to increase the diameter of the openings of the vent holes at the rear surface of the electrocast shell and reduce the number of said openings.

The above and other objects, features and advantages of the present invention will become more apparent from the following description of preferred embodiments.

DESCRIPTION OF THE PREFERRED EMBODIMENT

Figure 1:
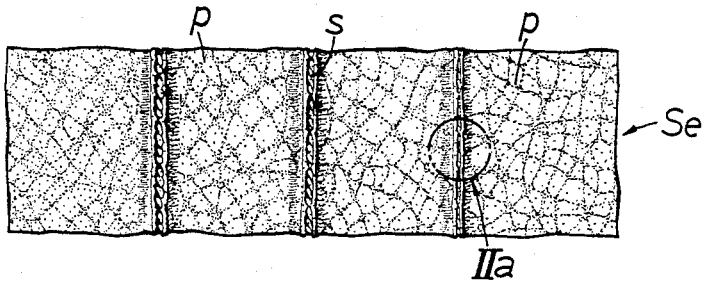
FIG. 1 is a plan view showing essential parts of an electrocast shell.
Figure 2A:
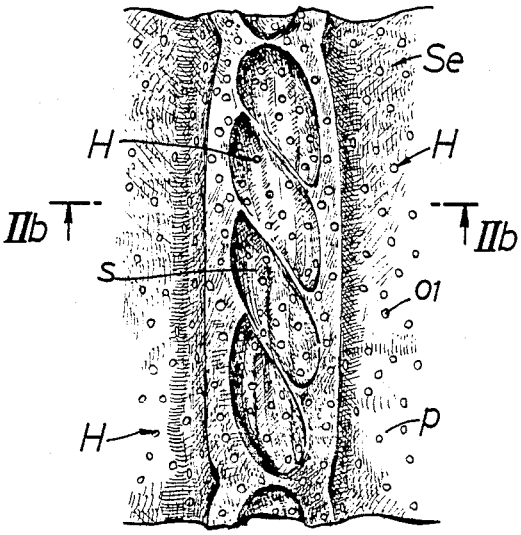
FIG. 2A is an enlarged view of detail IIa in FIG. 1.
Figure 2B:
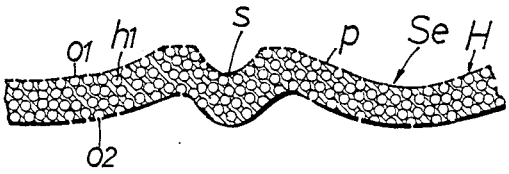
FIG. 2B is a sectional view taken on line IIb—IIb in FIG. 2A.

FIGS. 1,2A and 2B show a nickel electrocast shell Se obtained in accordance with the present invention. The electrocast shell Se has a predetermined shape (see FIGS. 4 and 7) and it has a surface formed with a grain pattern p, for example, simulating leather with stitched portions s. The electrocast shell Se is formed with a multitude of fine vent holes H distributed therethroughout to form a microporous body. The vent holes H are arranged respectively at pitches of 0.4 to 0.7 mm longitudinally and transversely, and have openings O1 at the front surface thereof of a diameter of 0.08 to 0.1 mm.

Since the openings O1 of the vent holes H are very small in diameter, the grain pattern p is not affected by imprinting of the openings.

The manufacture of the electrocast shell Se will now be described with reference to FIGS. 3A to 3E.

Figure 3A:
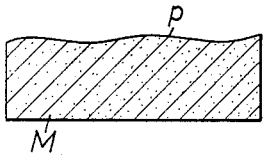
FIGS. 3A to 3E diagrammatically illustrate the steps of the method of the present invention.

Step (a) (FIG. 3A)

A precision model M having the grain pattern p is fabricated from gypsum.

Figure 3B:
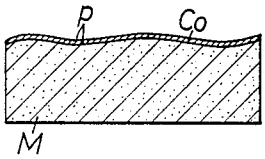

Step (b) (FIG. 3B)

The surface of the model M having the grain pattern p is subjected to a silver mirror treatment to form a thin conductive layer Co of silver on the surface, and the grain pattern p is present over the entire surface of the conductive layer Co.

Figure 3C:
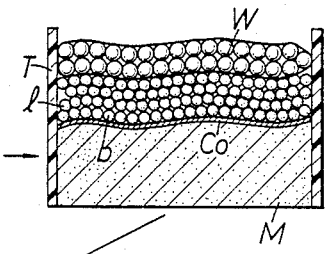

Step (c) (FIG. 3C)

The periphery of the model M is surrounded by an insulating cylindrical body T. A multitude of elutable polystyrene particles b having a diameter of 0.2 mm are stacked in approximately four sub-layers on the entire surface of the conductive layer Co to form a band or layer l of the polystyrene particles. An anti-floating body W comprising glass particles in a nylon net is placed on the layer l so that the polystyrene particles b in the lowermost sub-layer are pressed into close contact with the surface of the conductive layer Co. Thereby, each of the polystyrene particles b in the lowermost sub-layer comes into close point contact with the surface of the conductive layer Co.

Figure 3D:
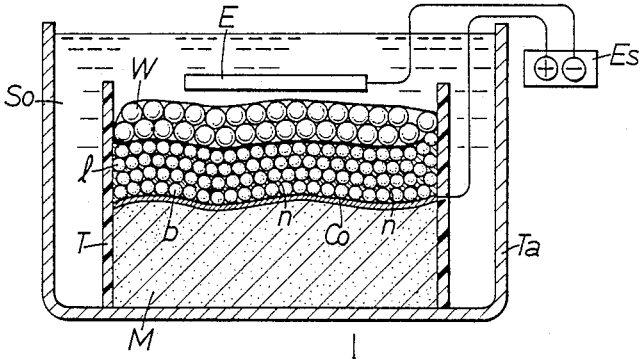

Step (d) (FIG. 3D)

The model M is put into a nickel plating solution So in an electrocasting tank Ta. The conductive layer Co is connected to the (+) terminal of a power source Es and an electrode E, opposite the anti-floating body W, is connected to the (−) terminal of the source Es whereby the model M is subjected to an electrocasting treatment. During this electrocasting treatment, the deposited nickel n fills the spaces between the conductive layer Co and the polystyrene particles b, except for the contact points between the conductive layer Co and the polystyrene particles b, and the deposited nickel n fills the spaces between the adjoining polystyrene particles b except for the contact points therebetween thereby to obtain the electrocast shell Se having the grain pattern p on the surface thereof. The thickness of the electrocast shell Se is set to be thinner than the layer l so that the surfaces of the polystyrene particles b in the uppermost sub-layer are slightly exposed from the electrocast shell Se.

Figure 3E:
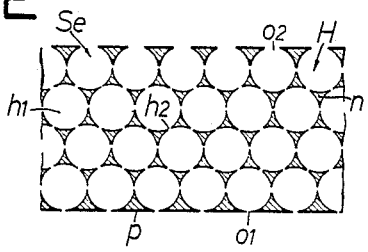

Step (e) (FIG. 3E)

After the electrocast shell Se has been separated from the conductive layer Co, the shell is immersed into a solvent, such as toluene, methylene chloride, or the like to elute the polystyrene particles b from the electrocast shell Se. In this case, since a part of the particles and the upper surface of layer l are exposed and since the particles at the surface with the grain pattern p are exposed at their contact points, the polystyrene particles b are dissolved at said exposed portions and contact points to form openings O2 and O1 respectively. The electrocast shell Se is internally formed with holes h1 after the polystyrene particles have been eluted which communicate through openings h2 at the contact points between the adjoining polystyrene particles b.

In this manner there is obtained electrocast shell Se in the form of a microporous body having a multitude of vent holes H with extremely small-diameter openings O1, O2 at respective surfaces thereof as shown in FIGS. 1,2A and 2B.

The particles that may be eluted include paraffin particles, aluminum particles and the like in addition to the aforementioned polystyrene particles b. In the case of paraffin particles, they are eluted from the electrocast shell by heating. In the case of aluminum particles, they are eluted from the electrocast shell by heating or by chemical etching.

Figure 4:
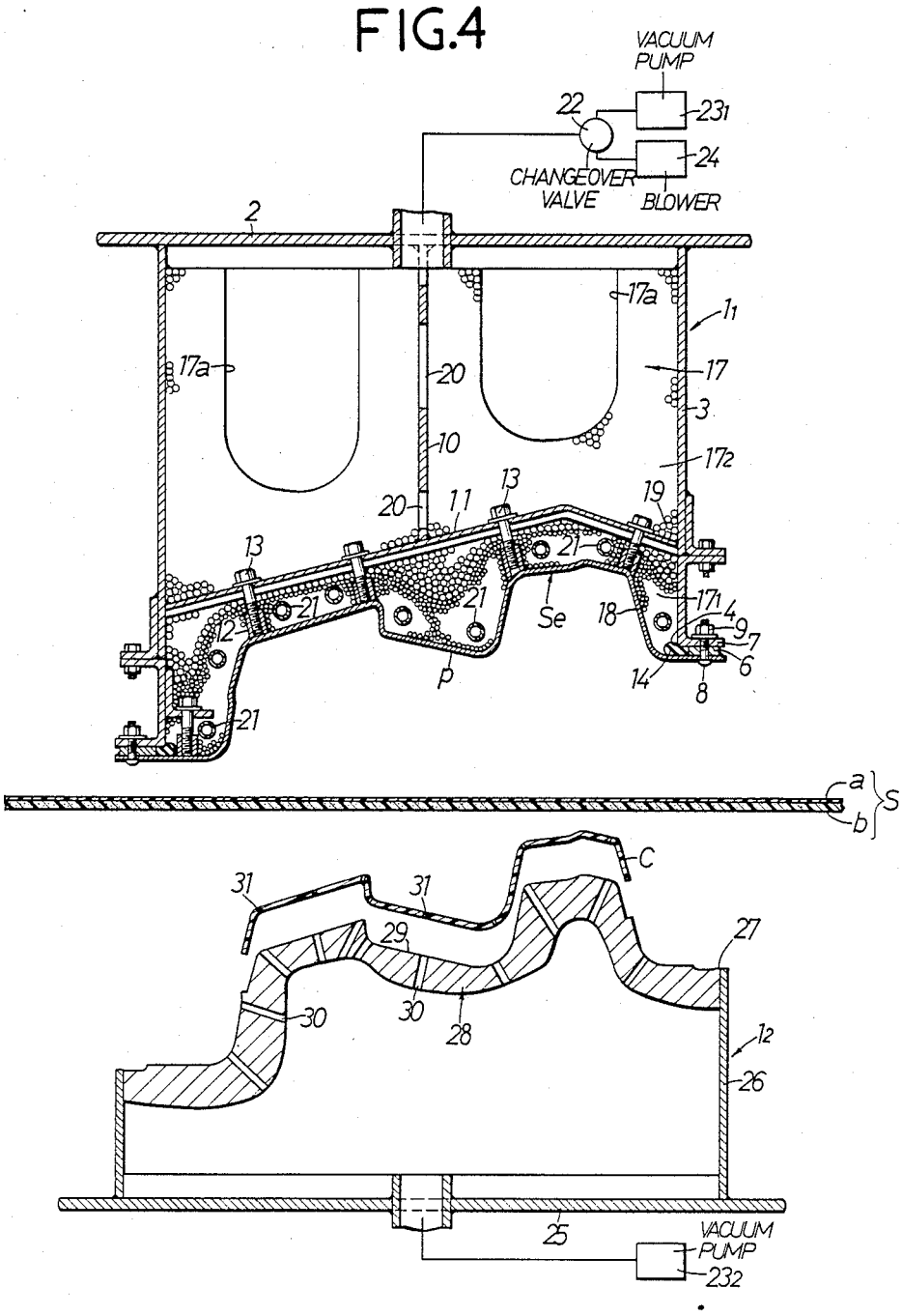
FIG. 4 is a sectional view of apparatus for obtaining a laminated layer having a grain pattern.

FIG. 4 shows an apparatus for obtaining a laminated body having grain pattern p, using the electrocast shell Se obtained in accordance with the present invention.

The apparatus comprises a vertically movable first movable portion $1_1$ and a vertically movable second movable portion $1_2$ located therebelow.

The first movable portion $1_1$ is constructed as follows.

A downwardly oriented opening 4 of a box 3 having a top wall 2 is closed by the electrocast shell Se with the grain pattern p facing downwardly. The outer peripheral edge of the shell Se is fixedly secured to a flange 7 of the box 3 through a pad 6 by means of a plurality of bolts 8 and nuts 9. A support plate 10 is suspended from the top wall 2 of the box 3, and intermediate portions of a plurality of angle members 11 are welded to the lower edge of the support plate 10 in a predetermined spaced relation in a plane perpendicular to FIG. 4. Both ends of each of the angle members 11 are welded to the inner surface of the box 3. The electrocast shell Se is supported by the angle members 11 by means of a plurality of bolts 13 screwed into threaded sleeves 12 welded to the rear surface of the electrocast shell Se. At the inner peripheral edge of the flange 7, a vacuum seal 14 is interposed between the edge and the shell Se.

Within the box 3, a porous back-up body 17 having continuous air holes is integrally joined to the rear surface of the electrocast shell Se so as to reinforce the shell Se. The back-up body 17 comprises a first layer $17_1$ disposed on the electrocast shell Se and comprising a multitude of adjoining steel balls 18 of excellent anticorrosion property, such as stainless steel. The steel balls are mutually joined together by a thermosetting plastic such as an epoxy resin. A second layer $17_2$ of the back-up body is laminated on the first layer $17_1$ and comprises a multitude of adjoining glass particles 19 mutually joined together by a thermosetting plastic, similar to the one joining the steel balls.

Figure 5:
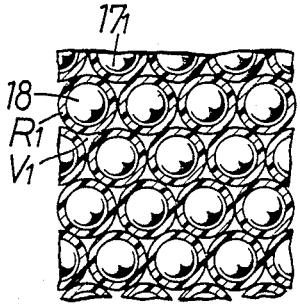
FIG. 5 is a sectional view of a part of a first layer of a back-up body of the apparatus in FIG. 4.

When the first layer $17_1$ is formed, a predetermined quantity of steel balls 18 of a diameter of 70 to 150$\mu$ with a resin layer $R_1$ formed of said thin thermosetting plastic on the surface thereof (as shown in FIG. 5) are introduced into the box 3 at the rear surface of the electrocast shell Se, after which the steel balls 18 with the resin layers $R_1$ are heated to 70° to 80° C. to join the contacting resin layers of the adjoining steel balls 18 to form gaps $V_1$ surrounded by the contact points. Continuous air holes are formed in the first layer $17_1$ by the gaps $V_1$. When the steel balls 18 are mutually joined together, the first layer $17_1$ and the electrocast shell Se are also joined together by the resin layers $R_1$.

Figure 6:
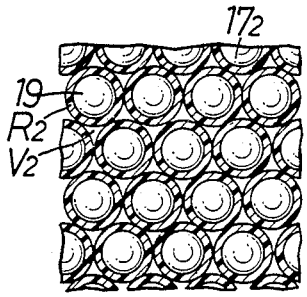
FIG. 6 is a sectional view of a part of a second layer of the back-up body.

When the second layer $17_2$ is formed, members (not shown) having the same shape as recess 17a are suspended within box 3 to form said recesses 17a in order to reduce the weight of the apparatus. A predetermined amount of glass particles 19 of a diameter between 400 to 600μ having thin resin layers $R_2$ on the surfaces thereof (as shown in FIG. 6) are introduced into the box 3 onto the first layer $17_1$, after which the glass particles 19 with the resin layers $R_2$ are heated to 70° to 80° C. to join the particles 19 at their contact points with the adjoining glass particles to form gaps $V_2$ surrounded by the contact points. Continuous air holes are formed in the second layer $17_2$ by the gaps $V_2$. When the glass particles 19 are mutually joined together, contact points between the first layer $17_1$ and the second layer $17_2$ are also joined by the resin $R_2$.

The support plate 10 is formed with a plurality of through-holes 20 through which the glass particles 19 can pass so as not to be interrupted by the support plate 10.

Cooling pipes 21 are embedded in the first layer $17_1$in a zigzag fashion so that the electrocast shell Se may be uniformly cooled over its entire extent. In this case, the first layer $17_1$ principally comprises the steel balls 18 and therefore has excellent heat conductivity. Accordingly, the electrocast shell Se may be cooled efficiently. The zigzag embedment of the cooling pipes 21 reinforces the first layer $17_1$.

The interior of the box 3 is connected through a changeover valve 22 to a vacuum pump $23_1$ and a blower 24.

The second movable portion $1_2$ is constructed as follows.

A press mold 28 having a shape for registration with the electrocast shell Se is fixedly secured at an upwardly oriented opening 27 of a box 26 having a bottom wall 25. The press mold 28 is formed at its upper surface with a recess 29 into which a core C can be fitted. The press mold 28 is also formed with a plurality of vacuum holes 30 extending therethrough and the holes 30 are approximately uniformly distributed over the entire mold. The interior of the box 26 is connected to a vacuum pump $23_2$.

A laminated body to be molded comprises a plastic sheet S and a core C. The plastic sheet S comprises a single layer of polyvinyl chloride or the like, or a laminated sheet which includes said single layer as a skin to which is secured a foam polypropylene cushion layer.

The core C is formed with a plurality of small-diameter vacuum attraction holes 31 in a plate of ABS resin or the like and the plate is registered with recess 29 in the press mold 28 such that the holes 30 in the mold are aligned with the holes 31 in the core C.

The manufacture of the laminated body will be described hereinafter.

The surface of the core C is coated with a hot melt adhesive, as an adhesive agent, and the adhesive is heated and softened.

In the state as shown in FIG. 4, the first movable portion $1_1$ has been moved upwards while the second movable portion $1_2$ has been moved downwards to open the electrocast shell Se and the press mold 28. The core C is fitted into the recess 29 of the press mold 28 with the adhesive-coated surface thereof facing outwards, and the vacuum attraction holes 31 are brought into registration with the vacuum attraction holes 30 of the press mold 28.

The plastic sheet S formed from skin layer a and cushion layer b is heated to a softening temperature of approximately 180° C., and the plastic sheet S is disposed between the first and second movable portions $1_1$ and $1_2$ *with the skin layer a on top.*

Figure 7:
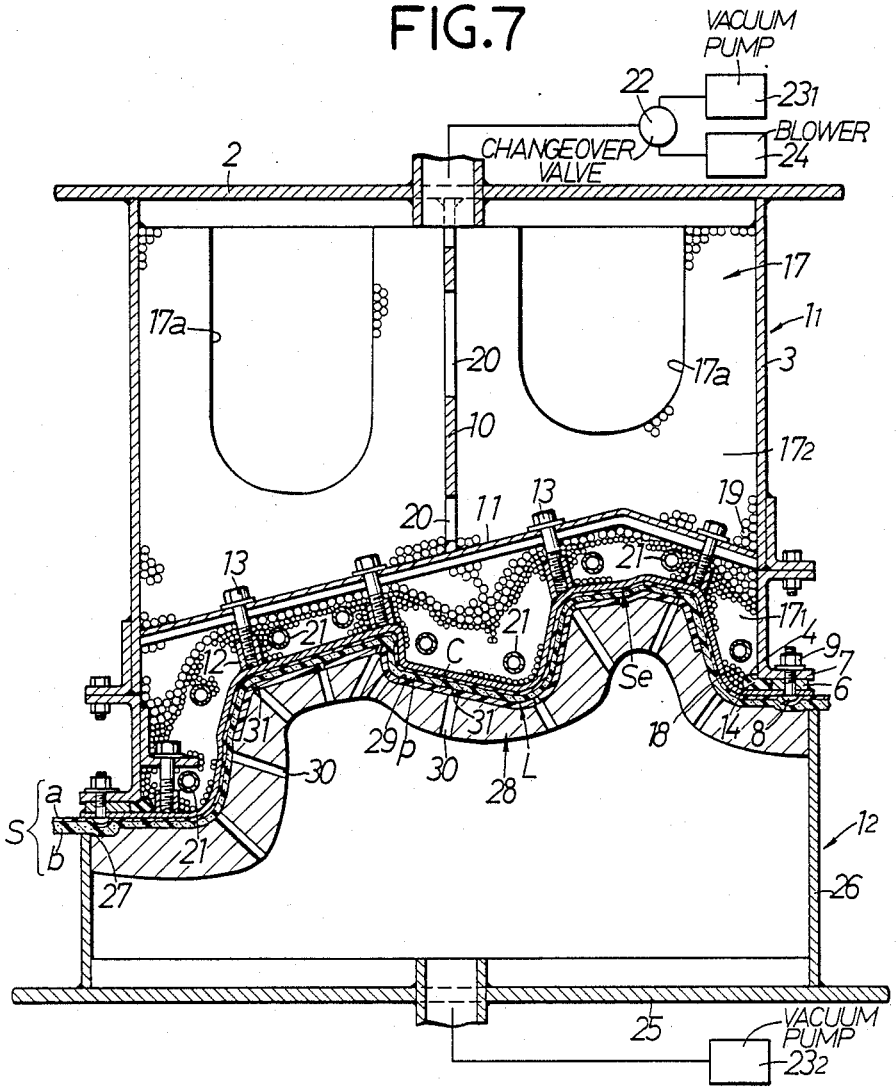
FIG. 7 is a sectional view of the apparatus in the molding step.

As shown in FIG. 7, the first movable portion $1_1$ is moved downwards while the second movable portion $1_2$ is moved upwards to clamp the plastic sheet S between the electrocast shell Se and the press mold 28. Since the plastic sheet S is pressed against the surface of the electrocast shell Se by the press mold 28, the sheet S will have good conformance to that surface.

The interior of the box 3 of the first movable portion $1_1$is connected to the vacuum pump $23_1$. The electrocast shell Se with the multitude of fine vent holes H over the entire extent thereof applies suction force to the plastic sheet S to insure that it conforms to the surface of the shell Se by the press mold 28. Therefore, the sheet S comes into tight and close contact with the whole surface of the shell Se whereby the grain pattern p will be accurately and clearly transferred or embossed onto the surface of the sheet S and at the same time the sheet S is formed into the shape of the electrocast shell Se. Since the electrocast shell Se is being cooled by the cooling pipes 21, the sheet S is immediately cooled to prevent the grain pattern p and the shape of the sheet S from changing.

The vacuum pump $23_2$ on the second movable portion $1_2$is actuated to suction the molded sheet S against the press mold 28 and the surface of the core C and blowing pressure is applied to the molded sheet by switching the interior of the box 3 of the first movable portion $1_1$ to the blower 24 through the changeover valve 22.

Thereby the molded sheet or body is released from the electrocast shell Se and comes into close contact with the core C to be joined therewith. Since the molded sheet is in firm and close contact with the electrocast shell Se, combined use of the suction force and blowing pressure constitutes an extremely effective means for promoting the release of the molded body.

The blower 24 is then halted, and the interior of the box 26 of the second movable portion $1_2$ is switched to atmospheric pressure, after which the first movable portion $1_1$is moved upwards while the second movable portion $1_2$ is moved downwards to permit removal of the laminated body L from the press mold 28.

The grain pattern p applied to the surface of the laminated body L is clear and distinct. In addition, the joining strength between the molded body formed from the plastic sheet S and the core C is great, and its durability is excellent.

Although the invention has been described in relation to a specific embodiment thereto, it will become apparent to those skilled in the art that numerous modifications and variations can be made within the scope and spirit of the invention as defined in the attached claims.

We claim:

1. A method of manufacturing an air permeable electrocast shell with a grain pattern on a surface thereof comprising forming a conductive layer on a surface of a model having a grain pattern such that said grain pattern is formed on said conductive layer; placing a layer of elutable particles into close contact with the surface of said conductive layer remote from the model; effecting an electrocasting treatment on said model so that portions between said conductive layer and said particles, except for contacting portions between said conductive layer and said particles and between adjoining particles, are filled by a deposited metal to form an electrocast shell, the metal being deposited in an amount such that the electrocast shell has a thickness less than that of said layer of particles; separating said electrocast shell from said model and eluting said particles from said electrocast shell to form fine vent holes in the shell having openings at both surfaces of said shell, the contacting portions of the elutable particles forming interconnecting passages between adjoining vent holes after elution of said particles, said contacting portions between said conductive layer and said particles becoming the openings at one of the surfaces of said shell at which said grain pattern is formed.

2. The method as claimed in claim 1 wherein said conductive layer comprises a thin silver layer.

3. The method as claimed in claim 1 wherein said elutable particles are selected from the group consisting of polystyrene particles, paraffin particles and aluminum particles.

4. The method as claimed in claim 1 wherein said elutable particles are polystyrene particles which are eluted by a solvent.

5. The method as claimed in claim 1 wherein said elutable particles are paraffin particles which are eluted by heating.

6. The method as claimed in claim 1 wherein said elutable particles are aluminum particles which are eluted by heating.

7. The method as claimed in claim 1 wherein said elutable particles are aluminum particles which are eluted by chemical etching.

8. The method as claimed in claim 1 wherein the deposited metal of said electrocasting treatment comprises nickel.

9. The method as claimed in claim 1 comprising pressing said layer of elutable particles against said conductive layer during the electrocasting treatment by applying a further layer of particles on said elutable particles.

10. The method as claimed in claim 9 comprising making the size of the elutable particles in the layer thereof less than the size of the particles in the further layer.

11. The method as claimed in claim 1 wherein the layer of elutable particles includes a plurality of sub-layers, said metal being deposited to a depth so that the particles in the topmost of the sub-layers are exposed at the surface of the metal.

12. A method as claimed in claim 1 wherein the size of said openings corresponding to the contact points of the particles with said conductive surface is made sufficiently small in relation to said grain pattern so as to have substantially no effect on a printed grain pattern utilizing the electrocast shell.

13. A method of manufacturing a porous electrocast shell with a grain pattern on a surface thereof comprising applying a thin conductive layer of silver on the surface of a model having a grain pattern such that said grain pattern is formed on the surface of said conductive layer; placing a layer of polystyrene particles into close contact with the surface of said conductive layer; electrodepositing nickel between the conductive layer and the layer of polystyrene particles to form an electrocast shell by filling spaces between said conductive layer and said polystyrene particles except for contact portions between said conductive layer and said polystyrene particles, and between adjoining polystyrene particles, the nickel being deposited in an amount so that the thickness of the electrocast shell is less than the thickness of the layer of said polystyrene particles; separating said electrocast shell from said model and immersing said electrocast shell into a solvent to elute said polystyrene particles from said electrocast shell and leave said shell with a multitude of fine vent holes which interconnect with one another via passages formed by the contacting portions of the polystyrene particles after elution thereof, the elution also forming openings at both surfaces of said electrocast shell which intercommunicate with said fine vent holes, said contact portions between said conductive layer and said particles becoming the openings at the surface of the shell at which the grain pattern is formed.

14. The method as claimed in claim 13 wherein said solvent comprises toluene.

15. The method as claimed in claim 13 wherein said solvent comprises methylene chloride.

16. The method as claimed in claim 13 comprising pressing said layer of polystyrene particles against the surface of the conductive layer during electrodeposit of the nickel by applying a further layer of removable particles on said layer of polystyrene particles.

17. A method as claimed in claim 13 wherein the size of said openings corresponding to the contact points of the particles with said conductive surface is made sufficiently small in relation to said grain pattern so as to have substantially no effect on a printed grain pattern utilizing the electrocast shell.

18. A method of manufacturing an electrocast shell which is air permeable and wherein the shell has a casting surface with a grain pattern thereon, said method comprising placing a layer of elutable particles onto an electrically conductive surface having a determined grain pattern thereon, electrodepositing a metal between the conductive surface and the elutable particles to form an electrocast shell in which spaces between said surface and the particles are filled except for contact points between said particles and eluting said particles from the shell to leave the shell with interconnected holes providing air permeability for the shell, said metal being electrodeposited to a thickness which is less than the thickness of the layer of particles such that particles project from one surface of the electrodeposited metal, and when the particles are eluted, the shell will be provided with openings at said one surface, the shell being formed at the other surface thereof, which was initially in contact with said conductive surface, with said determined grain pattern and with openings corresponding to the contact points of the particles with said conductive surface.

19. A method as claimed in claim 18 wherein said metal is electrodeposited to a thickness which is less than the thickness of the layer of particles such that particles project from one surface of the electrodeposited metal, and when the particles are eluted, the shell will be provided with openings at said one surface, the shell being formed at the other surface thereof, which was initially in contact with said conductive surface, with openings corresponding to the contact points of the particles with said conductive surface.

20. A method as claimed in claim 18 comprising separating said electrocast shell from said electrically conductive surface before said elution, the elution exposing at the surface of the shell the grain pattern from the electrically conductive surface and said openings corresponding to the contact points of the particles with the conductive surface.

21. A method as claimed in claim 18 wherein the size of said openings corresponding to the contact points of the particles with said conductive surface is made sufficiently small in relation to said grain pattern so as to have substantially no effect on a printed grain pattern utilizing the electrocast shell.

* * * * *